US005313679A

United States Patent [19]

Yamaguchi

[11] Patent Number: 5,313,679

[45] Date of Patent: May 24, 1994

[54] BED HAVING SYSTEM FOR MOVING MATTRESS UP AND DOWN

[76] Inventor: Yoshihisa Yamaguchi, 3-17, Kitakoiwa 7-chome, Edogawa-ku, Tokyo, Japan

[21] Appl. No.: 30,593

[22] Filed: Mar. 11, 1993

Related U.S. Application Data

[63] Continuation-in-part of Ser. No. 965,885, Oct. 23, 1992, Pat. No. 5,257,430.

[30] Foreign Application Priority Data

Feb. 28, 1992 [JP] Japan ..... 4-044064
Apr. 30, 1992 [JP] Japan ..... 4-111961

[51] Int. Cl.[5] ..... A47C 21/00; A47C 21/06
[52] U.S. Cl. ..... 5/659; 254/93 HP
[58] Field of Search ..... 5/659, 660, 615, 453, 5/455, 449, 454; 254/93 HP

[56] References Cited

U.S. PATENT DOCUMENTS

| | | | |
|---|---|---|---|
| 1,772,310 | 8/1930 | Hart | 5/615 |
| 3,026,541 | 3/1962 | Murat | 254/93 HP |
| 3,717,885 | 2/1973 | De Mare | 5/660 |
| 3,887,950 | 6/1975 | Wachsman | 5/11 |
| 4,697,290 | 10/1987 | Alkind et al. | 5/455 |
| 4,719,685 | 1/1988 | Anderson | 254/93 HP |
| 4,807,313 | 2/1987 | Ryder et al. | 5/660 |
| 4,934,002 | 6/1990 | Watanabe | 5/659 |
| 4,965,897 | 10/1990 | Taylor | 5/453 |
| 4,977,629 | 12/1990 | Jones | 5/455 |

FOREIGN PATENT DOCUMENTS

| | | | |
|---|---|---|---|
| 1282876 | 4/1991 | Canada . | |
| 2444122 | 3/1976 | Fed. Rep. of Germany . | |
| 2373996 | 12/1976 | France | 5/451 |
| 2394275 | 6/1977 | France . | |
| 3207308 | 9/1990 | Japan | 5/615 |

*Primary Examiner*—Alexander Grosz
*Attorney, Agent, or Firm*—Thompson, Hine and Flory

[57] ABSTRACT

This invention relates to a bed having a base, a mattress, and a system for moving the mattress up and down for helping a person make the bed, and can be preferably adapted in a guest room of hotels or the like. The present invention provides a bed comprising a base, a mattress provided on a top face of the base, a pair of inflatable means provided between the mattress and the base, and an air-supplying tube connected with said inflatable means, wherein one of the inflatable means is laid on one side of the top surface of the base, while the other is laid on the other side of the top surface of the base, and each inflatable means is independently connected to an air-supplying means through the air-supplying tube.

7 Claims, 11 Drawing Sheets

BED HAVING SYSTEM FOR MOVING MATTRESS UP AND DOWN

CROSS-REFERENCE TO RELATED APPLICATION

This is a Continuation-In-Part Application of U.S. patent Application, Ser. No. 07/965,885 filed Oct. 23, 1992, now U.S. Pat. No. 5,251,430.

BACKGROUND OF THE INVENTION

1. Field of the Invention

This invention relates to a bed having a base, a mattress, and a system for moving the mattress up and down for helping a person make the bed, and can be preferably adapted for beds in a guest room of hotels or the like.

2. Description of the Prior Art

Making the bed is one of the routine jobs for a person in charge of preparing the guest rooms in hotels, in which the person spreads bed covers such as sheets and blankets over the mattress and lifts the mattress with one hand to fold the corners of the bed covers under the mattress. The person must repeat these steps over and over, within a short period of time in order to make many beds. Therefore, a system for helping a person make beds has been in demand.

FIG. 12 shows a bed containing the conventional helping system disclosed in the document of Japanese patent application (TOKKAI-HEI-3-207308). This bed 1 comprises a base 2, a mattress 3 provided on a top face 2A of the base 2, and an inflatable body 4 provided between the base 2 and the mattress 3. As shown in the Figure, the inflatable body 4 is centered on the top face 2A of the base 2 and has a square-shaped elastic bag which can be connected with an air-supplying means 6 through tubes 5, 7 and a valve 8. These tubes 5, 7 form a passage of compressed air flow from the air-supplying means 6, while the valve 8 provided between the above tubes 5, 7 controls the stoppage or flow of air to the inflatable body 4.

Generally, the air supplying means 6 is an air-supply tube connected to an air compressor, a gas cylinder or the like for supplying a large amount of compressed air to the inflatable body 4. In the Figure, however, only one end of the air-supply tube is shown.

The conventional system described above is used as follows:

(i) first, connecting the air-supplying tube 7 with the air-supplying means 6, and with the air-introducing tube 5 of the inflatable body 4 through the valve 8, in order to introduce the compressed air into the body 4;

(ii) opening the valve 8 in order to allow the compressed air to flow into the inflatable body 4;

(iii) filling the inflatable body 4 with a supply of the compressed air in order to lift the mattress and to make a space between the base 2 and the mattress 3;

(iv) closing the valve 8 in order to stop the compressed air flow to the inflatable body 4 and to simultaneously avoid an out flow of the air therefrom;

(v) spreading the corners of the bed covers 9 over the mattress 3 and then folding them under the mattress 3; and (vi) opening the valve 8 in order to release the air from the inflatable body 4 and move the mattress 3 down resulting in the placement of the corners of the bed covers 9 between the mattress 3 and the base 2.

In this way, the system described above helps the person who makes the bed.

However, as described above, the conventional system requires a large amount of compressed air from the air-supplying means 6 connected to the air compressor or the like to fill the inflatable body 4. Thus, it is difficult to provide a hotel with an air-supplying means to supply an adequate amount of compressed air to each guest room when the use of the above conventional system is in demand.

SUMMARY OF THE INVENTION

An object of the present invention is to provide a bed comprising a pair of inflatable means disposed between a base and a mattress. One of the inflatable means is laid on one side of the top surface of the base, while the other is laid on the other side of the top surface of the base. Each of the inflatable means has an air-supplying tube independently connected to an air-supplying means for supplying compressed air.

According to one of the embodiments of the present invention, the inflatable means has a body in the form of an envelope-shaped air bag.

According to another embodiment of the present invention, the inflatable means has a plurality of inflatable parts and a plurality of noninflatable parts which are alternately disposed between the inflatable parts so as to communicate with each other. In this case, it is preferable that the inflatable part has a body in the form of a bellows-shaped air bag.

It is also preferable that the air-supplying means is a foot pump, but is not limited to such a pump.

The above and other related objects and features of the present invention will be apparent from the following description of the disclosure, and the accompanying drawings. In addition, the novelty thereof will be made apparent in the appended claims.

BRIEF DESCRIPTION OF THE DRAWINGS

In order that the invention may be readily carried into effect, it will now be described with reference to the accompanying drawings, wherein.

DESCRIPTION OF THE PREFERRED EMBODIMENTS (1) A bed having a pair of inflating means characterized by a body comprising an envelope-shaped air bag.

Figure 1:
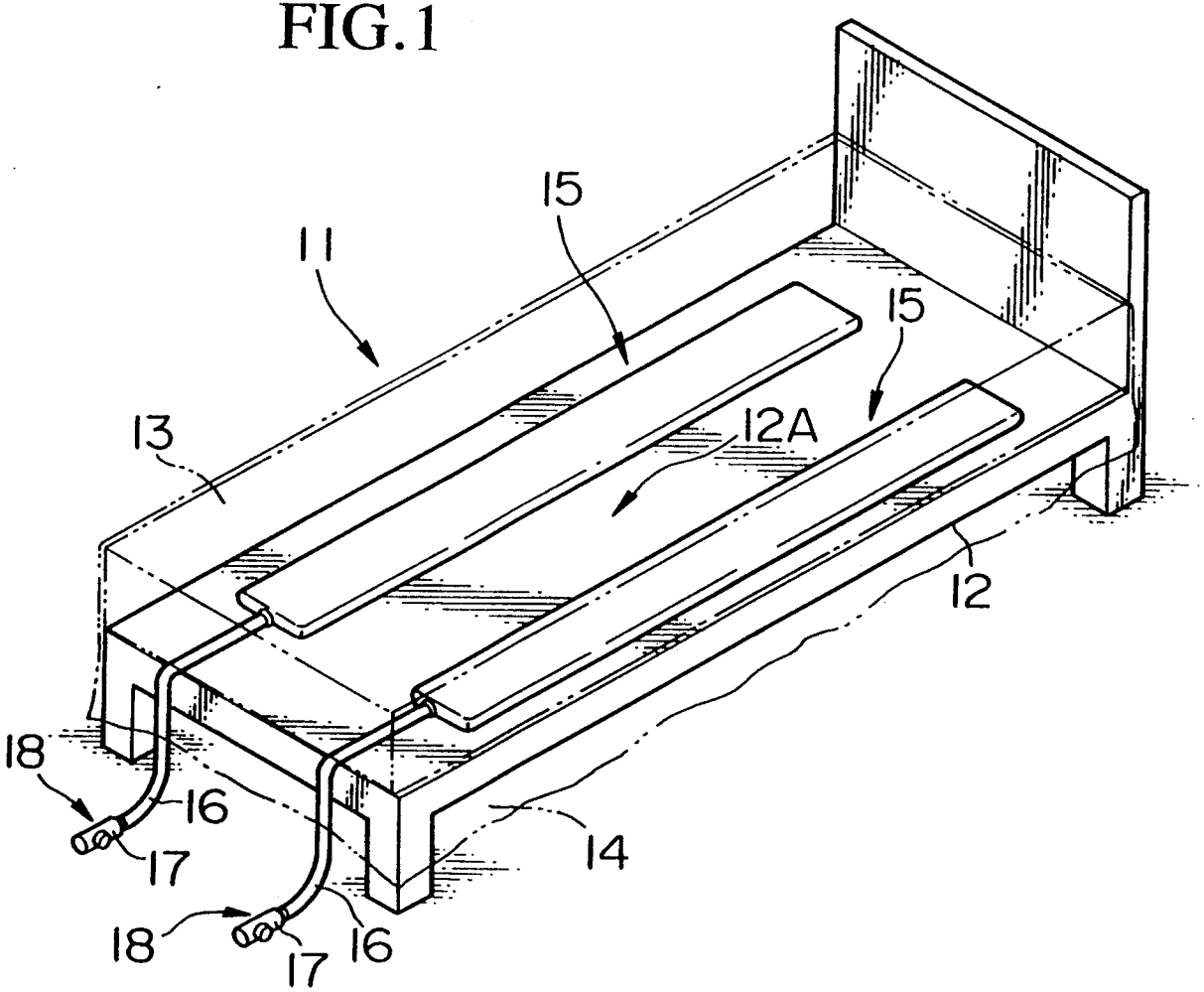
FIG. 1 is a view of an embodiment of the bed having a system which moves the mattress up and down in accordance with the present invention, and in which the system is in a non-operational condition.
Figure 2:
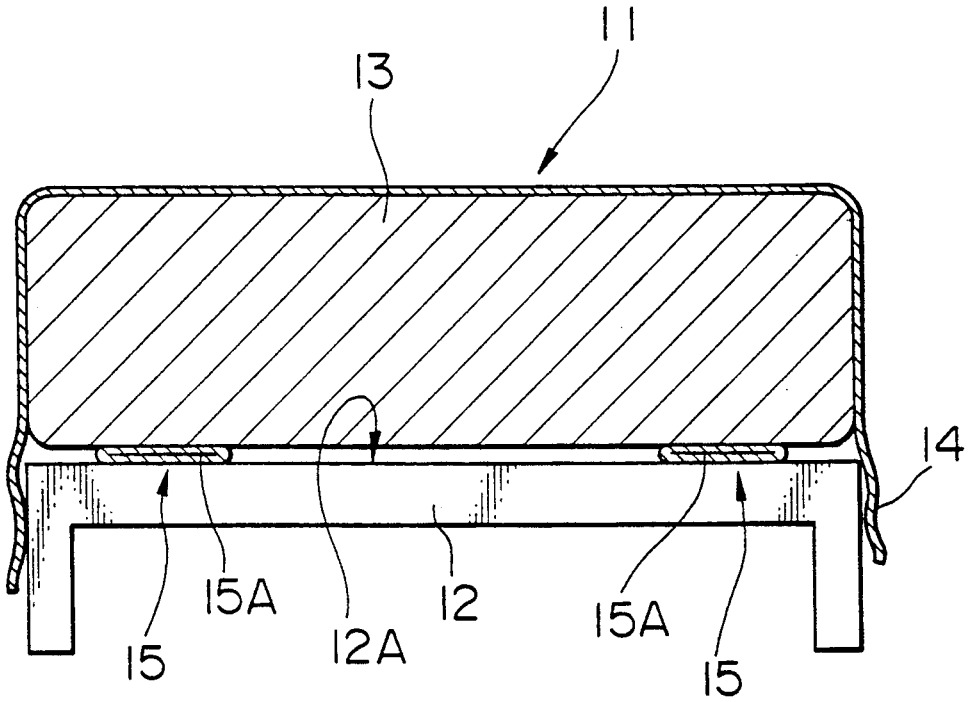
FIG. 2 is a sectional view showing the system of FIG. 1 in the nonoperational condition.
Figure 3:
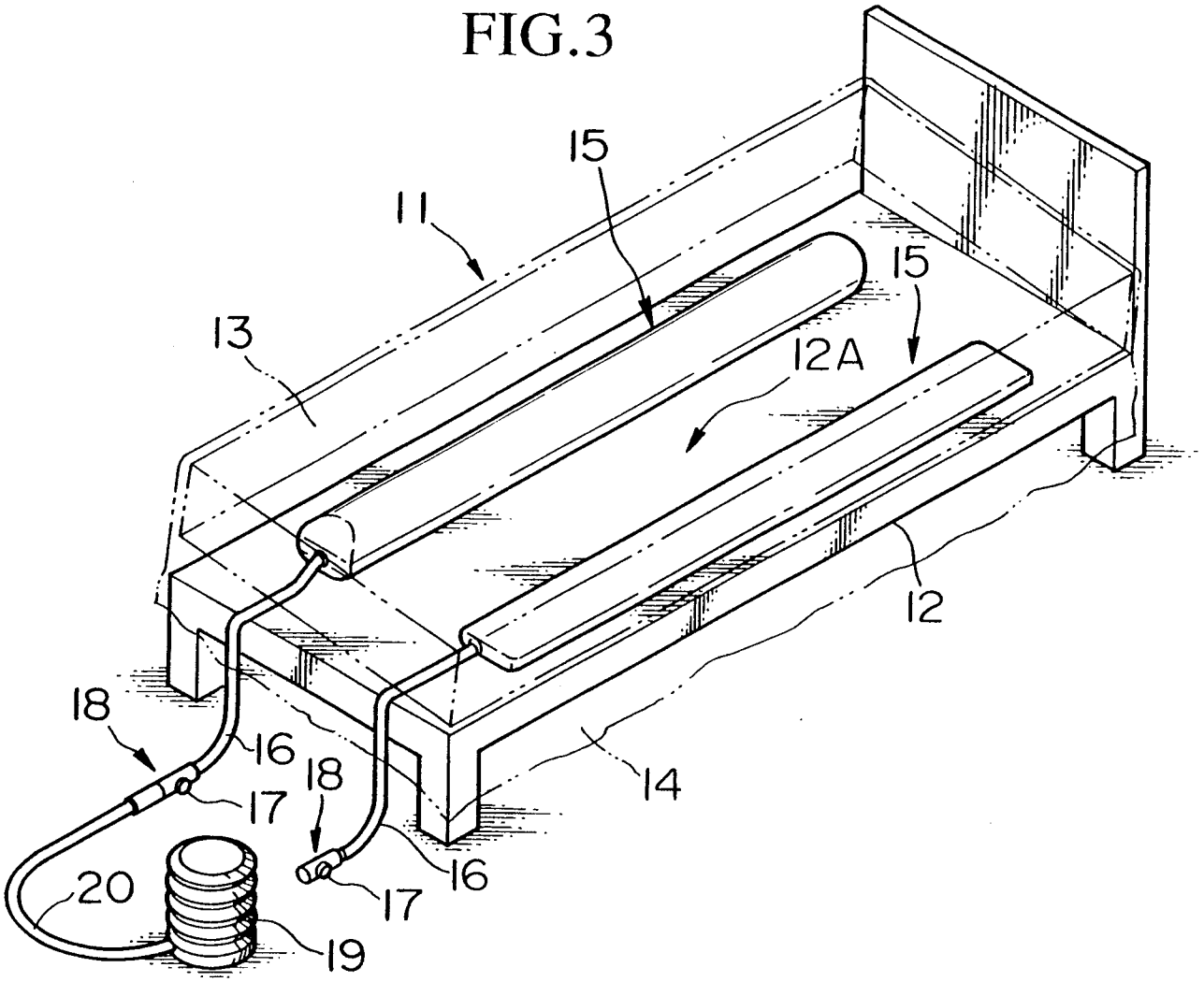
FIG. 3 is a view of the bed having the system of FIG. 1 in an operational condition.
Figure 4:
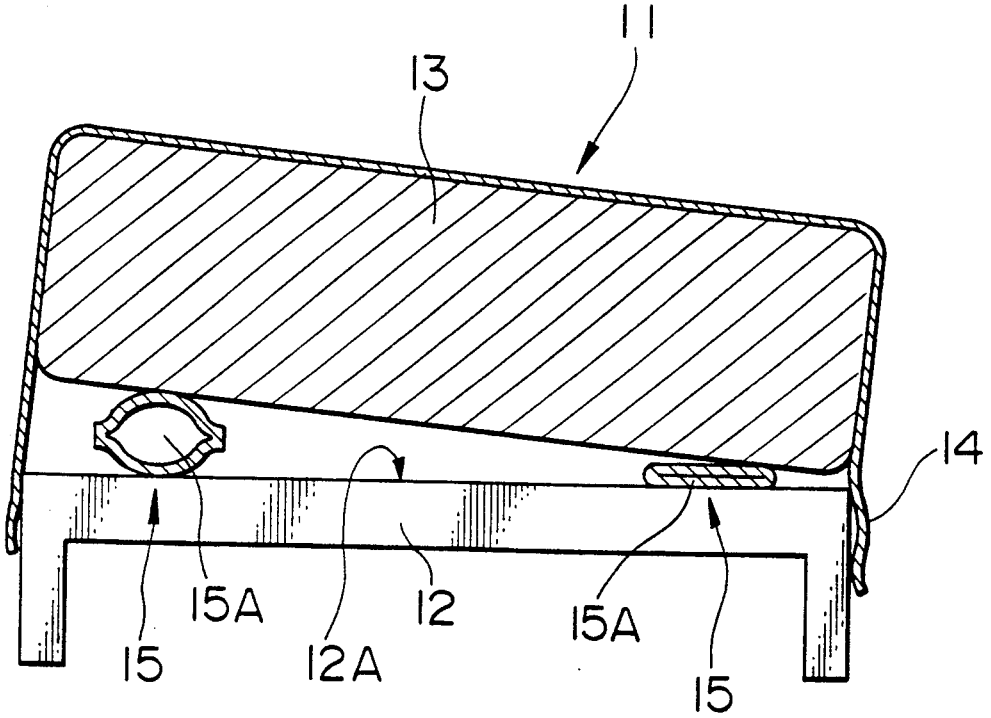
FIG. 4 is a sectional view showing the system of FIG. 1 in the condition of FIG. 3.
Figure 5:
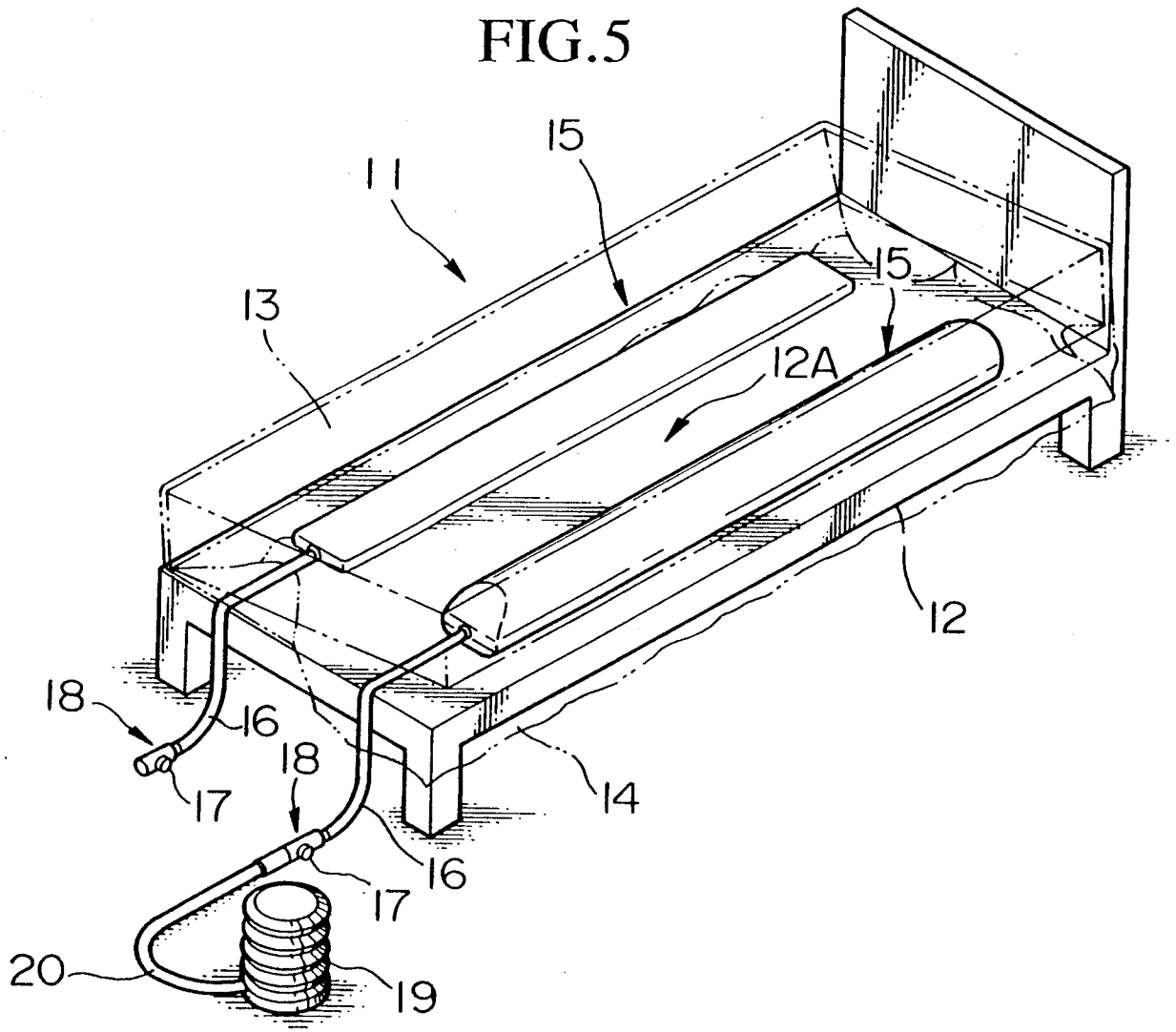
FIG. 5 is a view of the bed having the system of FIG. 1 but in another operational condition.
Figure 6:
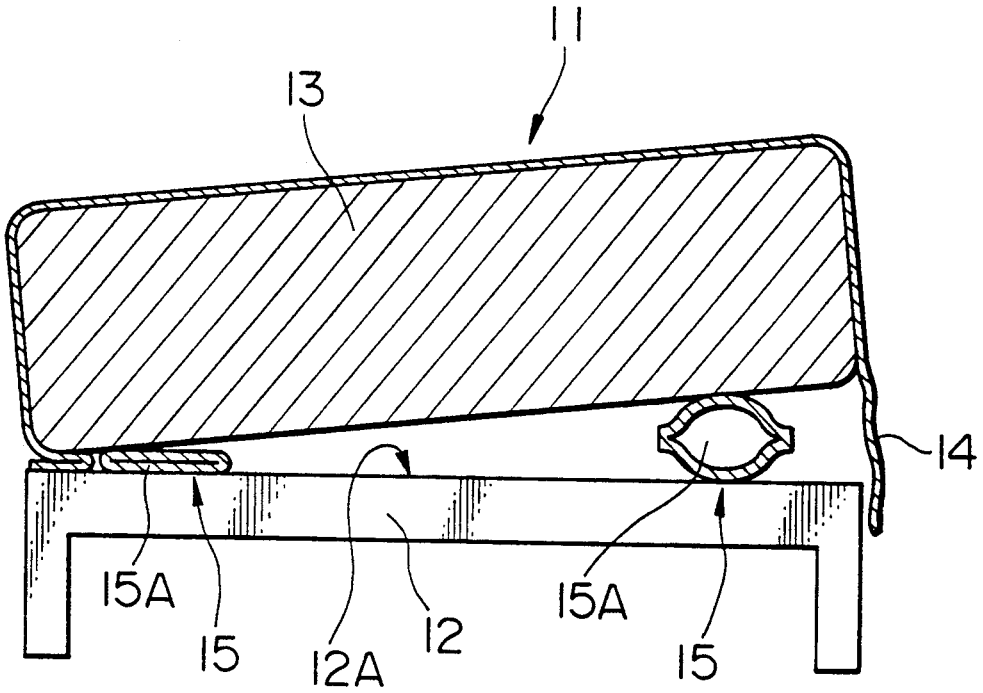
FIG. 6 is a sectional view showing the system of FIG. 1 in the condition of FIG. 5.

FIGS. 1 to 6 show one of the embodiments in accordance with the present invention. In these Figures, a bed 11 comprises a base 12 and a mattress 13 provided on a top face 12A of the base 12, over which bed covers 14 are spread, and a pair of inflatable means 15 are disposed between the base 12 and the mattress 13.

Each inflatable means 15 is made of an elastic material such as synthetic rubber or the like and has a shape of long and narrow air bag similar to an envelope. That is to say, the inflatable means 15 is formed from two long and narrow plates of the elastic material which are sealed along the peripheral borders, and have an air space 15A which is formed between the two plates, for containing compressed air. Then, one of the inflatable means 15 is laid on one long side of the top surface 12A of the base 12, while the other is laid on the other long side of the top surface 12A of the base 12, and each inflatable means 15 is arranged in parallel.

Moreover, each inflatable means 15 has an air-supplying tube 16. This air-supplying tube 16 is connected at one end to the inflatable means 15 in order to communicate with the air space 15A thereof, and at the other end it is attached to a connector 18 having a valve 17 which prevents the back flow of air. The connector 18 is connected to the end of an outlet tube 20 of an air-supplying means such as a portable foot pump 19 described in the Figures. In addition, the air-supplying tube 16 can be stored between the base 12 and the mattress 13 when not in use.

In this embodiment, the compressed air supplied from a portable foot pump 19 flows into the air space 15A through the outlet tube 20, the connector 18, and the air-supplying tube 16. When the compressed air is supplied to the space 15A, the inflatable means 15 fills up and the mattress 13 is lifted up from the base 12. on the other hand, when the compressed air is not supplied or blocked by the connector 18, the inflatable means 15 is flattened by the weight of the mattress 13. Each inflatable means 15 is independently connected to the air-supplying means, so that it is possible to alternatively and independently inflate one inflatable means 15 or the other 15 in order to lift one or the other side of the mattress 13.

A process of making a bed using the above-described system in accordance with the first embodiment of the present invention is as follows (see FIGS. 3 to 6):

(i) connecting one tube 16 of one inflatable means 15 with the outlet tube 20 of the foot pump 19 through the connector 16 in order to supply the compressed air to one of the inflatable means 15;

(ii) filling the air space 15A of one of the inflatable means 15 with compressed air by stepping on the foot pump 19 in order to raise one side of the mattress 13 and to make a space between the mattress 13 and the base 12;

(iii) stopping the air supply from the foot pump 19, and preventing a backward flow of the air because of the presence of the valve 17 of the connector 18 which prevents the back-flow of air;

(iv) making the bed by turning down the corners of the ed covers 14 spread over the mattress 13 and folding these corners under the mattress 13;

(v) opening the valve 17 to release the air from the inflatable means 15 in order to move the mattress 13 down, and consequently placing the corners of the bed covers 14 between one side of the mattress 13 and the base 12; and then (vi) detaching the outlet tube 20 from the one air-supplying tube 16, then connecting the outlet tube 20 with the other air-supplying tube 16 of the other inflatable means 15, and repeating steps (ii)–(v) described above, for making the other side of the bed 11.

(2) A bed having a pair of inflatable means comprising a plurality of inflatable parts and a plurality of noninflatable parts.

Figure 7:
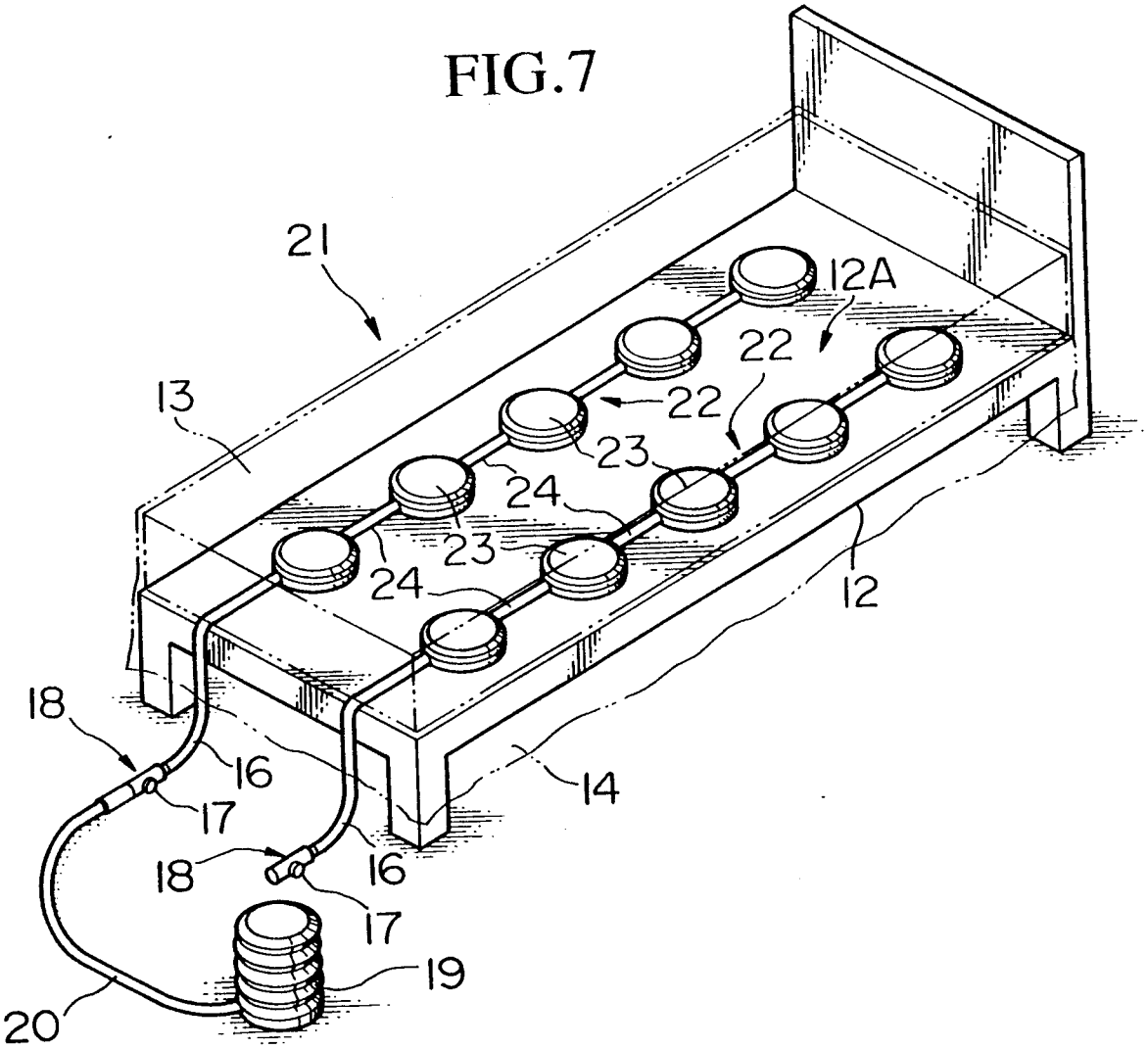
FIG. 7 is a view of another embodiment of the bed having a system for moving the mattress up and down in accordance with the present invention, in which the system is in a nonoperational condition.
Figure 8:
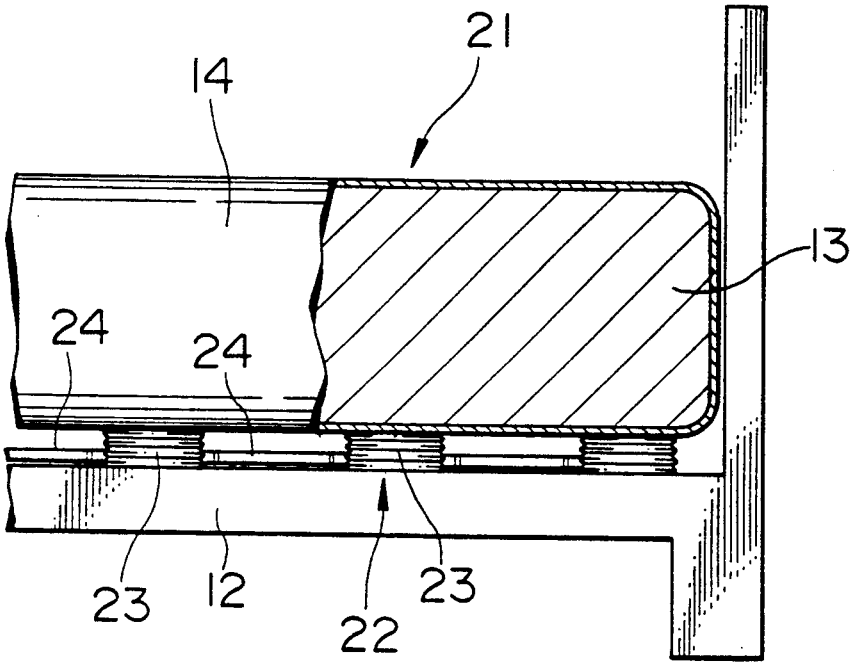
FIG. 8 is a partial schematic sectional view showing the system of FIG. 7 in the nonoperational condition.
Figure 9:
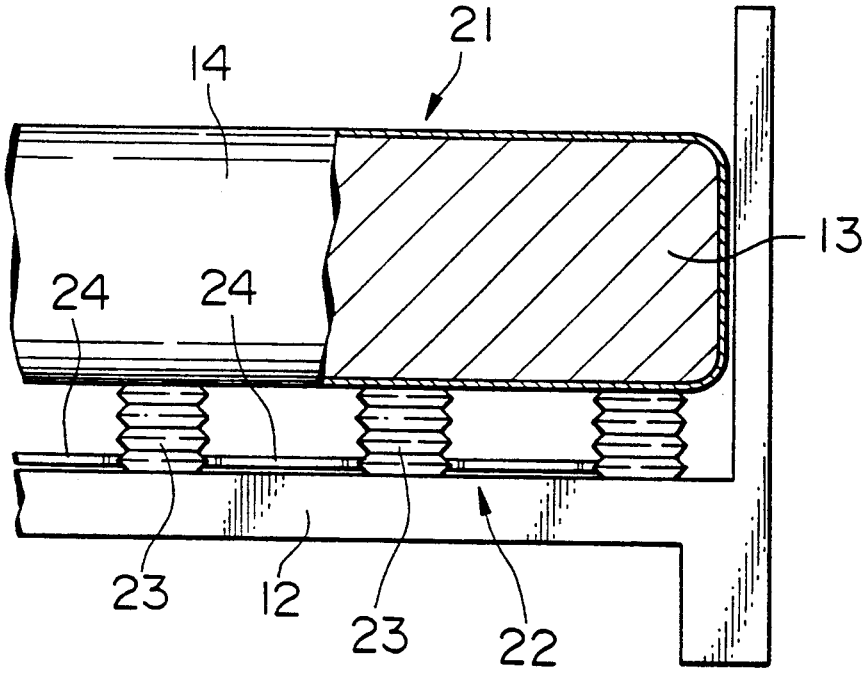
FIG. 9 is a partial schematic sectional view showing the system of FIG. 7 in the operational condition.
Figure 10:
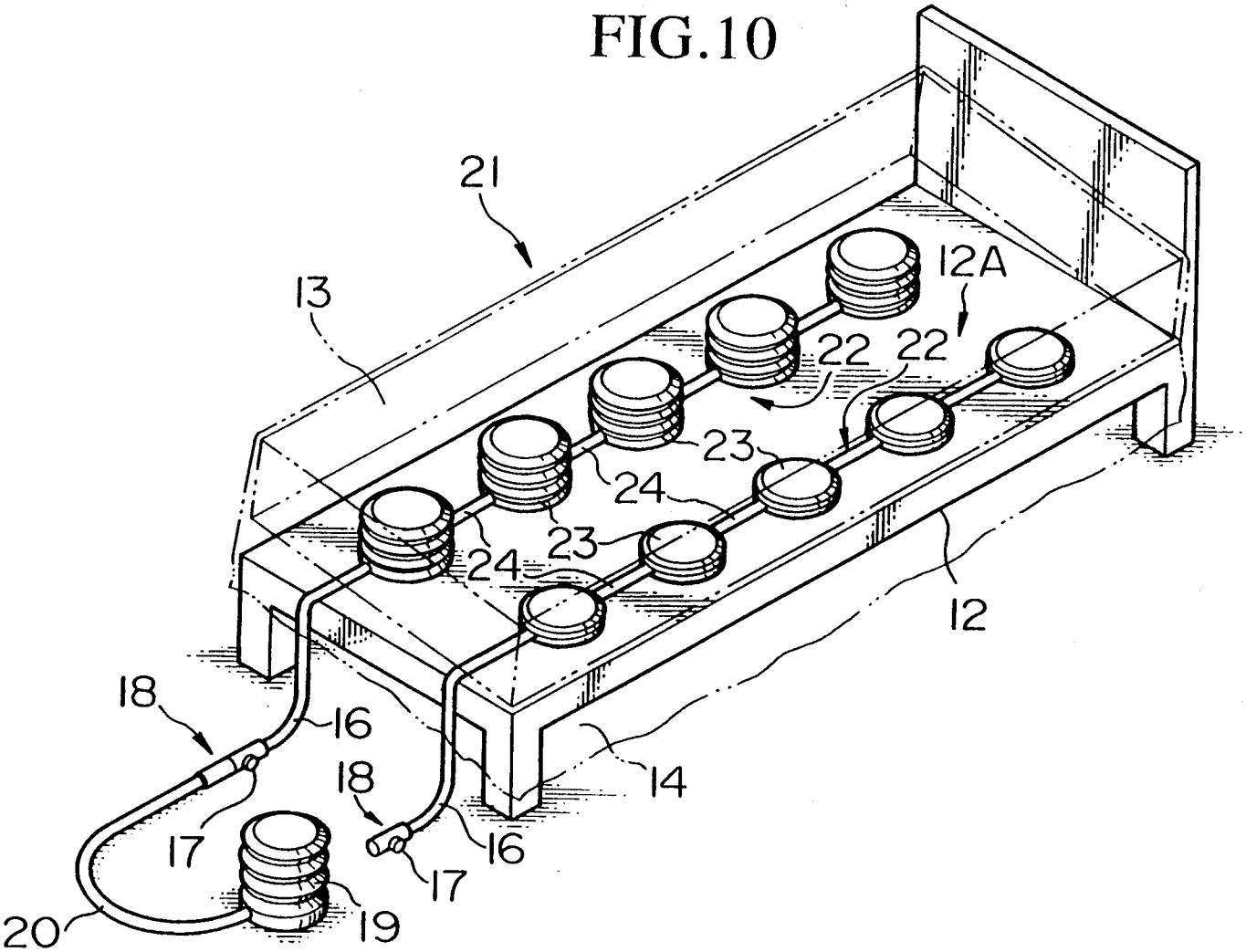
FIG. 10 is a view of the bed having the system of FIG. 7, in which the system is in another operational condition.
Figure 11:
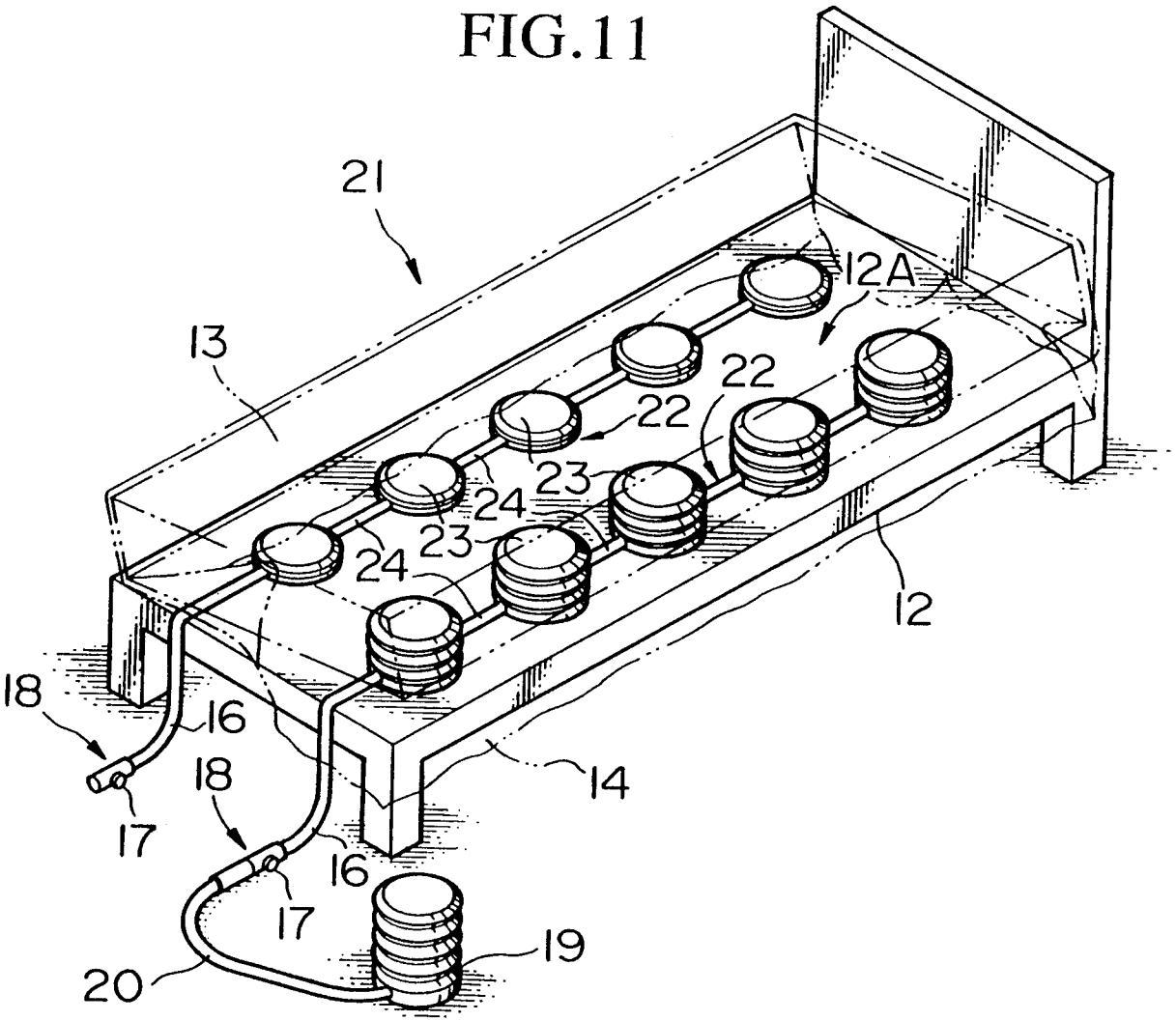
FIG. 11 is a view of the bed having the system of FIG. 7, in which the system is in yet another operational condition.
Figure 12:
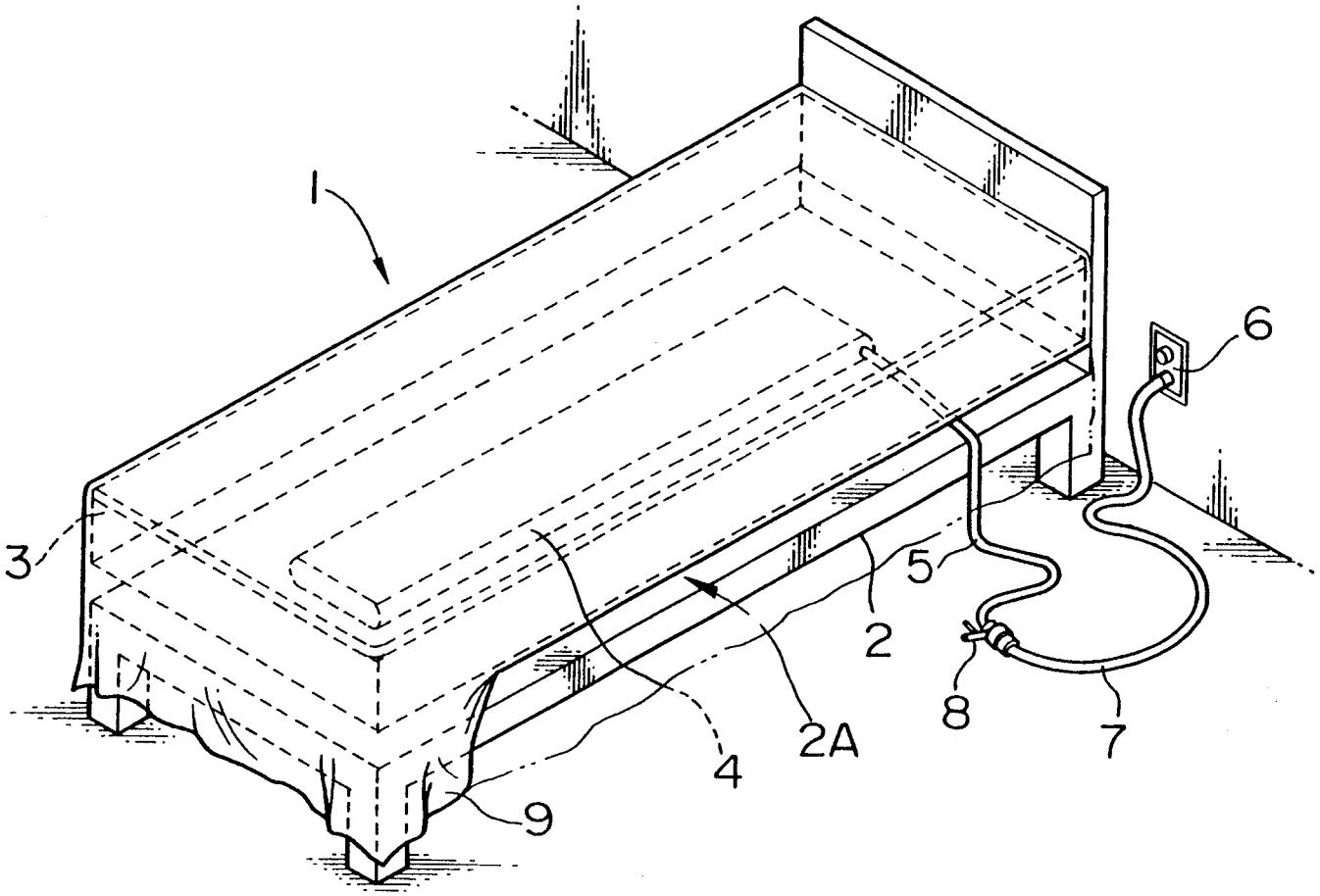
FIG. 12 (PRIOR ART)
FIG. 12 is a view of the bed having the conventional system of moving the mattress up and down.

FIGS. 7 to 11 show another embodiment in accordance with the present invention which is the same as the first embodiment except for the construction of an inflatable means.

In this embodiment, a bed 21 also has a pair of inflatable means 22 laid on each long side of the top surface 12A of the base 12. However, the inflatable means 22 has a plurality of sealed expandable portions 23 and a plurality of tubular noninflatable portions 24 both made of elastic material such as vinyl chloride. Each expandable portion 23 has a bellows-shaped body like a foot pump so as to expand upward, and each tubular portion 24 is disposed between the expandable portions 23 so as to communicate with each other.

In this embodiment, each inflatable means 22 is also connected with an air-supplying tube 16. Each tube 16 can be connected which an outlet tube 20 of a pump 19 through a connector 18 having a valve 17 which prevents the back-flow of air.

When the compressed air is not supplied from the pump 19, and when the mattress 13 is laid on the base 12, the expandable portions 23 are flattened by the weight of the mattress 13. On the other hand, when the compressed air is supplied from the pump 19, the expandable portions 23 are filled and expand upward, and the mattress 13 is consequently separated from the base 12.

A process of making a bed using the above systems is as follows:

(i) connecting one air-supplying tube 16 of one inflatable means 22 to the outlet tube 20 of the foot pump 19 through the connector 18 in order to supply the compressed air;

(ii) filling up the expandable portions 23 of the one inflatable means 22 with compressed air by stepping on the foot pump 19 in order to lift up one long side of the mattress 13 and to make a space between the mattress 13 and the base 12;

(iii) stopping the air supply from the foot pump 19, wherein a backward flow of the air is prevented by the valve 17 of the connector 18 which prevents the back-flow of air;

(iv) making the bed by turning down the corners of sheets and blankets of the bed covers 14 spread over the mattress 13 and folding them under the mattress 13;

(v) opening the valve 17 to release the air from one inflatable means 22 to move the mattress 13 down, and consequently the corners of one side of the bed covers 14 are placed between the mattress 13 and the base 12; and then (vi) detaching the tube 20 from the one air-supplying tube 16, then connecting the outlet tube 20 with the other air-supplying tube 16 of the other inflatable means 22, and repeating steps (ii)-(v) described above, for making the other side of the bed 21.

Accordingly, the beds having an inflatable means in accordance with the present invention will help the person who makes the bed. Also, the inflatable means described in (1) and (2) do not require a large amount of compressed air because the mattress 13 can be easily lifted up, one side at a time, by supplying compressed air independently to each of the inflatable means laid on each side of the top face 12A of the base 12. Therefore, there is no need to use a large system such as an air compressor or the like for the supply of compressed air, and also there is no need to remodel the building in order to provide an air-supplying tube in the wall of each guest room of the hotel.

According to the first embodiment described in (1) of the present invention, the inflatable means 15 has a body in the form of an envelope-shaped air bag formed from two plates and is flattened when the air is not contained in the air bag 15A. Therefore, the inflatable means 15 is not usually subjected to stress from the weight of the mattress 13 except for when the bed is being made. Therefore, it is possible to prevent the deformation of the inflatable means 15 made of elastic material. Also, in this embodiment, the flattened inflatable means 15 is so thin that it will not affect the comfort of the mattress 13 when being slept on.

In accordance with the second embodiment described in (2) of the present invention, it is possible to lift up the mattress 13 with less compressed air than in the first embodiment because the inflatable means 22 comprises a plurality of inflatable parts and a plurality of noninflatable parts. Therefore, the mattress 13 can be lifted more easily and the person can make a bed more quickly.

Although, what has been described in this specification is at present considered the preferred embodiment of the invention, it is understood that various modifications can be made therein, and therefore it is intended that the appended claims cover all such modifications which fall within the true spirit and scope of the invention.

What is claimed is:

1. A bed (11) consisting essentially of base (12), a mattress (13) provided on top face (12A) of said base (12), a pair of inflatable means (15) provided between said mattress (13) and said base (12), wherein each of said inflatable means (15) has a body in the form of an elongated envelope-shaped air bag formed from two plates sealed along their peripheral borders, each of said inflatable means (15) having an air supplying tube (16) connected at one end to said inflatable means (15), whereas one of said inflatable means (15) is laid on one side of said top face (12A) of said base (12), while the other said inflatable means (15) is laid on the other side of said top (12A) of said base (12), and each of said inflatable means (15) is independently connected to an air-supplying means (19) through said air-supplying tube (16).

2. A bed (11) according to claim 1, wherein said inflatable means (15) is made of an elastic material.

3. A bed (11) according to claim 1, wherein said air-supplying means (19) is a foot pump.

4. A bed (21) comprising a base (12), a mattress (13) provided on a top face (12A) of said base (12), a pair of inflatable means (22) provided between said mattress (13) and said base (12), wherein each f said inflatable means (22) has a plurality of inflatable parts (23) and a plurality of noninflatable parts (24) alternately provided between said inflatable parts (23) so as to communicate with each other, each of said inflatable means (22) having an air supplying tube (16) connected at one end to said inflatable means (22), wherein one of said inflatable means (22) is laid on one side of said top face (12A) of said base (12), while the other said inflatable means (22) is laid on the other side of said top face (12A) of said base (12), and wherein each of said inflatable means (22) is independently connected to an air-supplying means (19) through said air-supply tube (16).

5. A bed (21) according to claim 4, wherein said inflatable part (23) has a body in the form of a bellows-shaped air bag.

6. A bed (21) according to claim 4 wherein said inflatable means (22) is made of an elastic material.

7. A bed (21) according to claim 4, wherein said air-supplying means (19) is a foot pump.

* * * * *